United States Patent [19]

Hoglund

[11] 4,380,227

[45] Apr. 19, 1983

[54] GRINDING WHEEL DRESSING APPARATUS

[76] Inventor: Nils Hoglund, #408B, 100 E. Linton Blvd., Delray Beach, Fla. 33444

[21] Appl. No.: 380,081

[22] Filed: May 20, 1982

[51] Int. Cl.[3] ..... B24B 53/08

[52] U.S. Cl. ..... 125/11 PT

[58] Field of Search ..... 125/11 TP, 11 PT, 11 R, 125/11 CC

[56] References Cited

U.S. PATENT DOCUMENTS 2,452,509 10/1948 Victory ..... 125/11 PT 3,022,780 2/1962 Hoglund ..... 125/11 PT

*Primary Examiner*—Harold D. Whitehead

*Attorney, Agent, or Firm*—Malin & Haley

[57] ABSTRACT

An improved grinding wheel dressing apparatus for reproducing a contour on a grinding wheel from an enlarged contour or master form. The improvement in my previous U.S. Pat. No. 3,022,780 includes a novel linkage system for interconnecting the tool slide and follower slide to produce proportional fractional movement of the tool slide in response to movement of the follower slide. This linkage eliminates all sliding friction and sliding wear by eliminating all sliding interconnections to this linkage. All linkage interconnections are now simple pivot connections. Elimination of these sliding linkage interconnections also reduces manufacturing costs and simplifies manufacturing. All linkage length adjustments have also been eliminated to avoid this difficult adjustment in the field.

1 Claim, 10 Drawing Figures

Section E-E

Section A-A.

Section B-B

Section C-C

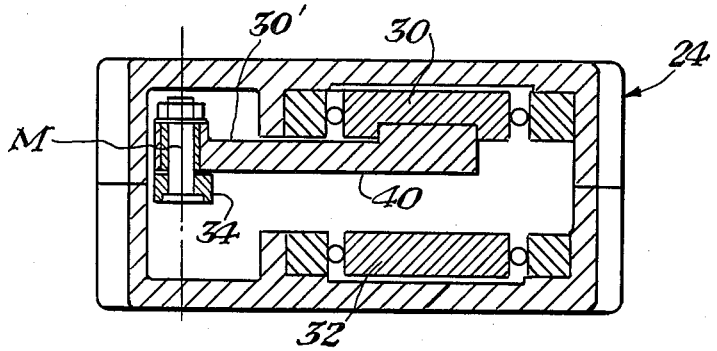
Fig. 6. Section D-D
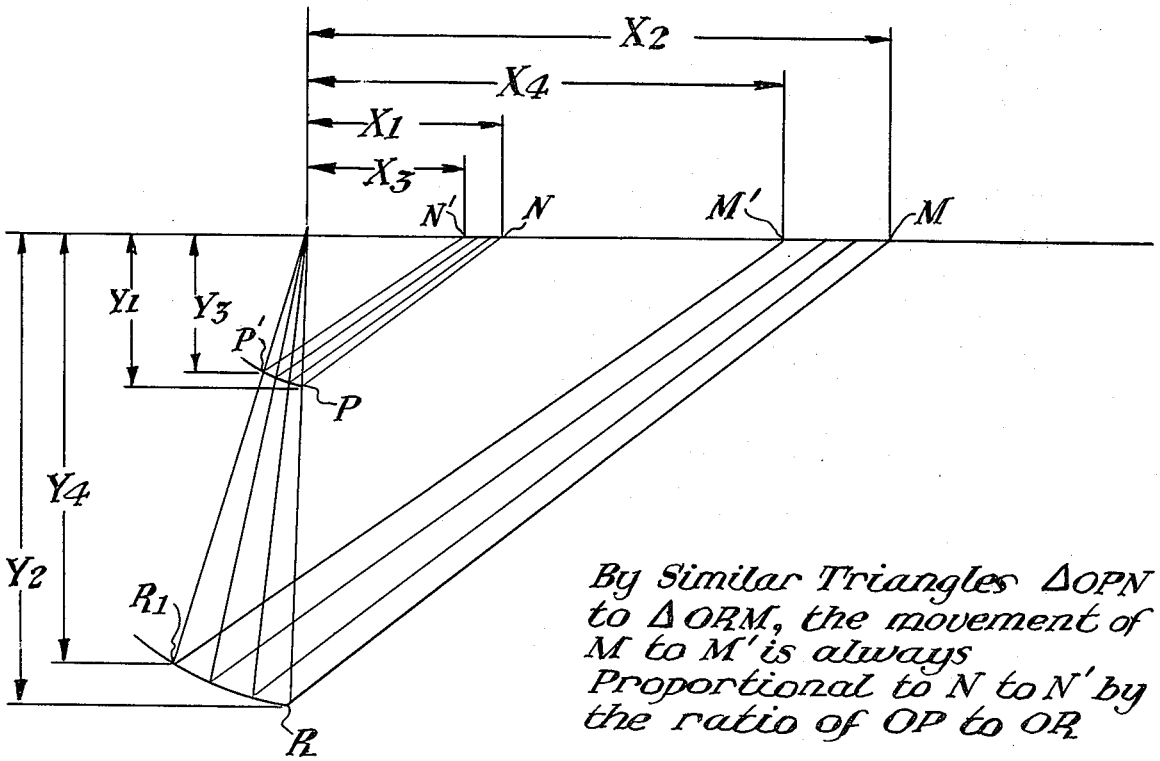
Fig. 10.

GRINDING WHEEL DRESSING APPARATUS

BACKGROUND OF THE INVENTION

This invention relates generally to a grinding wheel dressing apparatus for reproducing a contour on the peripheral surface of the grinding wheel from an enlarged contour or master form. Obvious substantial improvements in accuracy are attained by controlling the dressing operation by following a several times enlarged contour. Having a template contour of, for example, ten times as large as the desired grinding wheel contour also permits hand fabrication of the template because any template inaccuracy is reduced by, as in this example, ten.

My previous U.S. Pat. No. 3,022,780, hereby incorporated by reference, discloses such a grinding wheel dressing apparatus. The drawings from that patent are herein incorporated by reference. However, one of the two linkage systems therein, that for fractional linear translation of the follower slide motion to that of the tool slide, included inherent practical and functional limitations which the instant improvements overcome. These limitations relate to the requirement that two of the three linkage interconnectors, to the tool slide 37 at 84′ and to the housing 24 at 86′, be both pivotable and sliding connections, and also to the micrometer ratio adjustment screw 88. The practical limitations of the old linkage include expense and difficulty in manufacturing this linkage. Further, the micrometer ratio adjustment previously included was then required to be made by the field operator, proving to be a source of tedious, time-consuming inaccuracy. The curious operator, once having needlessly dismantled the mechanism, was typically challenged beyond capability to reassemble and adjust the linkage to perform properly.

Another practical limitation inherent in my old linkage was the double wear factor at each of the above two connecting points. Because both pivotal and sliding motion occurred at each said interconnection, inaccuracies due to wear at both pivotal and sliding points occurred in unexpectedly shortened time periods.

A major functional limitation, therefore, in addition to the dual wear problem inherent in said interconnections, is the increased operating friction therein created. Because this is a hand-controlled and guided apparatus, any undue operating resistance to movement breeds further inaccuracy.

The instant invention overcomes the above limitations by providing a novel linkage system for the above-said purpose having only pivotable interconnections. Additionally, all adjustment previously required of the operator has been eliminated.

BRIEF DESCRIPTION OF THE INVENTION

An improved grinding wheel dressing apparatus, said apparatus having a housing slide attached to the grinding wheel apparatus and having thereon a yoke support rotatably supporting a housing. Mounted within the housing is a tool slide and a follower slide movable parallel to each other. The tool slide, follower slide and housing are pivotally interconnected by ratio linkage which determines and provides the ratio of movement of the two slides within the housing during dressing operations. This ratio linkage also includes a micrometer type ratio adjuster. The housing has attached to it a template support adapted to support a template which is engaged by a follower mounted on an extension of the follower slide. The grinding wheel cutting tool is rotatably supported on the tool slide, while the follower is rotatably supported on the extension. A link mechanism is operably connected between the follower and the tool to rotationally position the dressing diamond of the tool according to the corresponding rotational positioning of the follower by the operator.

The improvement provided by the instant invention relates to a novel linkage for interconnecting the follower slide and the tool slide. This linkage includes three pivotally connected links, the first link pivotally connected at its ends between the follower slide and one end of the second link, which second link is pivotally connected at its second end to the housing. A third link is pivotally interconnected at its ends between the tool slide and a mid-point on the second link.

This new linkage performs a similar function to that of the old linkage, i.e. to produce a proportionately smaller translation movement of the tool slide in response to translatory movement of the follower slide as the follower is manually moved along the template profile. However, because the micrometer ratio adjustment has been eliminated, the movement ratio between the follower slide and the tool slide is accurately fixed when the linkage is machined.

It is an object of this invention to provide a ratio linkage for a grinding wheel dressing apparatus which is less expensive and simpler to manufacture.

It is another object of this invention to provide a ratio linkage for a grinding wheel dressing apparatus absent any ratio adjustment available or required to be made by the field operator.

It is yet another object of this invention to provide a ratio linkage for a grinding wheel dressing apparatus having reduced wear characteristics.

And still another object of this invention is to provide a ratio linkage for a grinding wheel dressing apparatus having reduced operating friction characteristics for smoother, more accurate operation.

In accordance with these and other objects which will be apparent hereinafter, the instant invention will now be described with particular reference to the accompanying drawings.

BRIEF DESCRIPTION OF THE DRAWINGS

FIG. 6 is another end elevation view of section D—D in FIG. 2.

FIG. 10 is a diagram for explaining the ratio movements of the slide.

PREFERRED EMBODIMENT OF THE INVENTION

Figure 1:
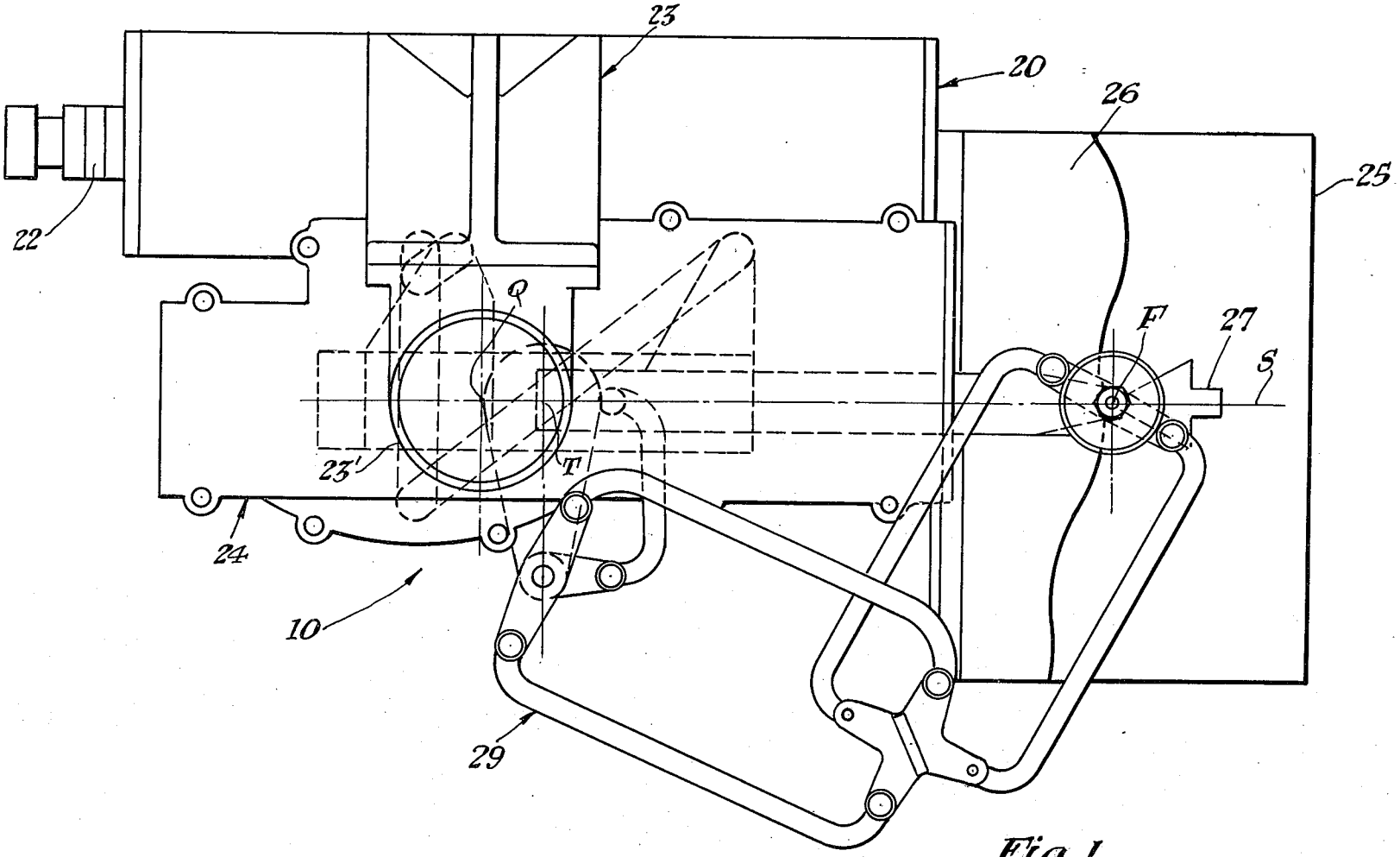
FIG. 1 is a plan view of the entire grinding wheel dressing apparatus.
Figure 2:
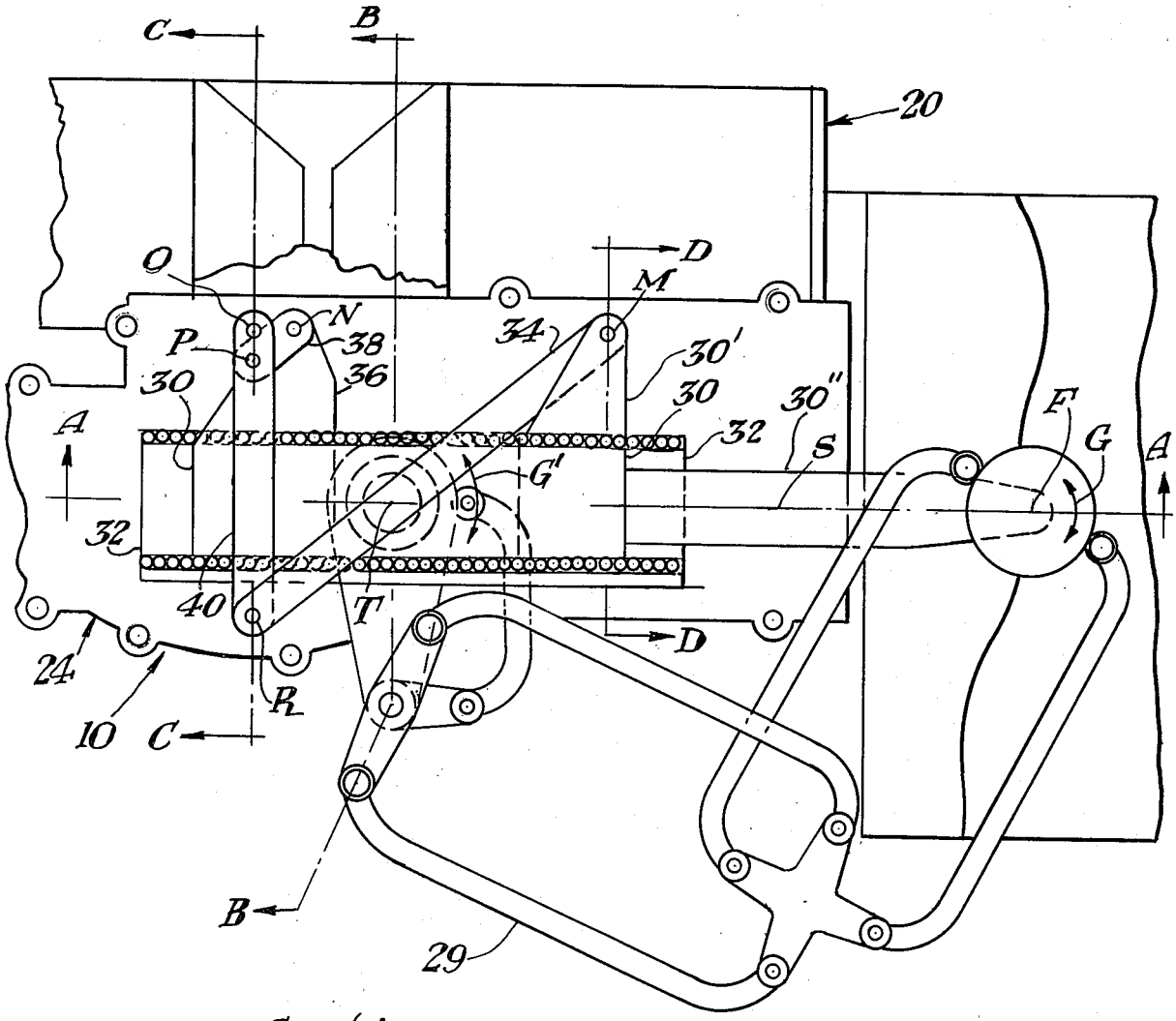
FIG. 2 is a partial sectional plan view through section E—E in FIG. 3.
Figure 3:
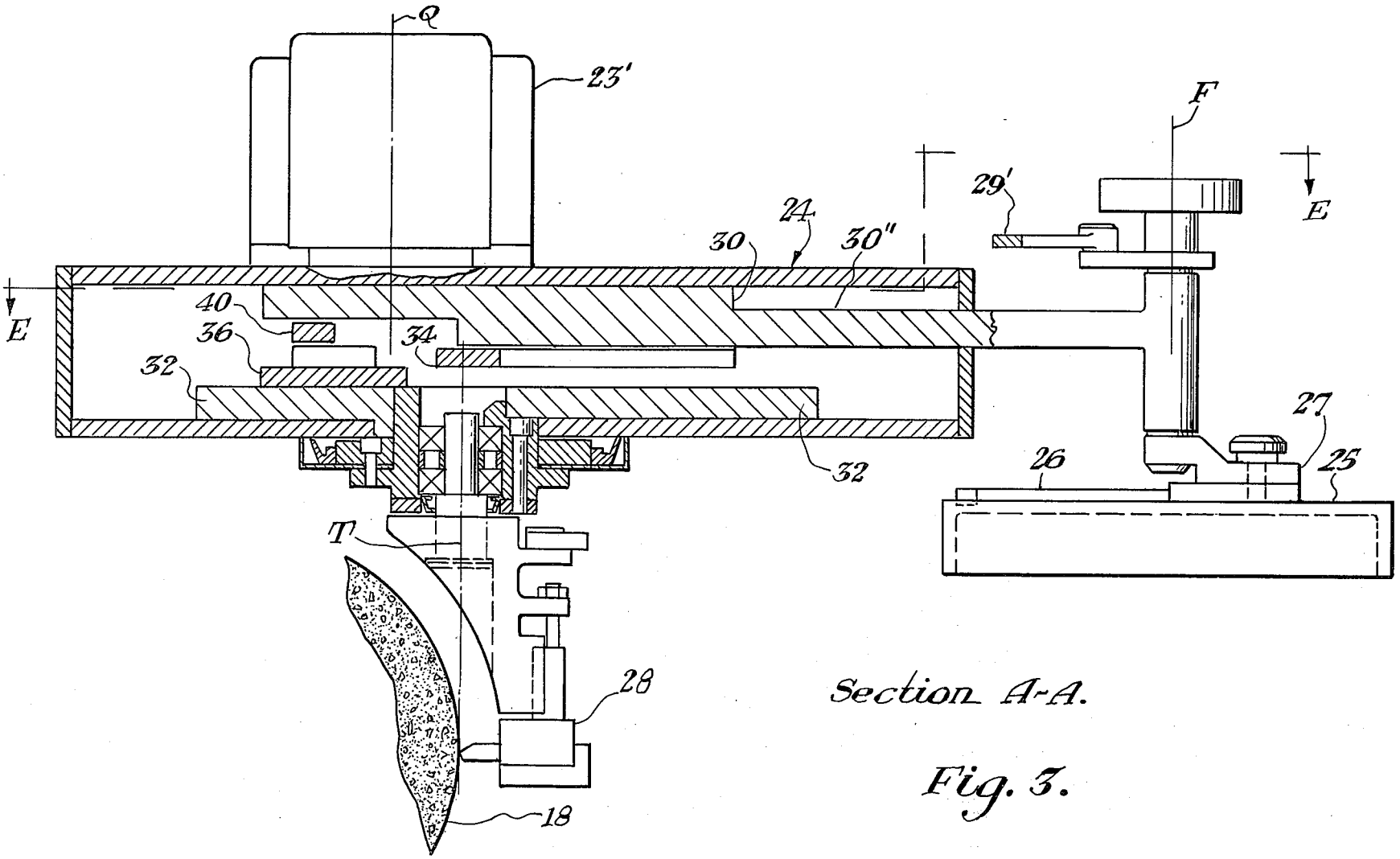
FIG. 3 is a side elevational view of section A—A in FIG. 2.
Figure 4:
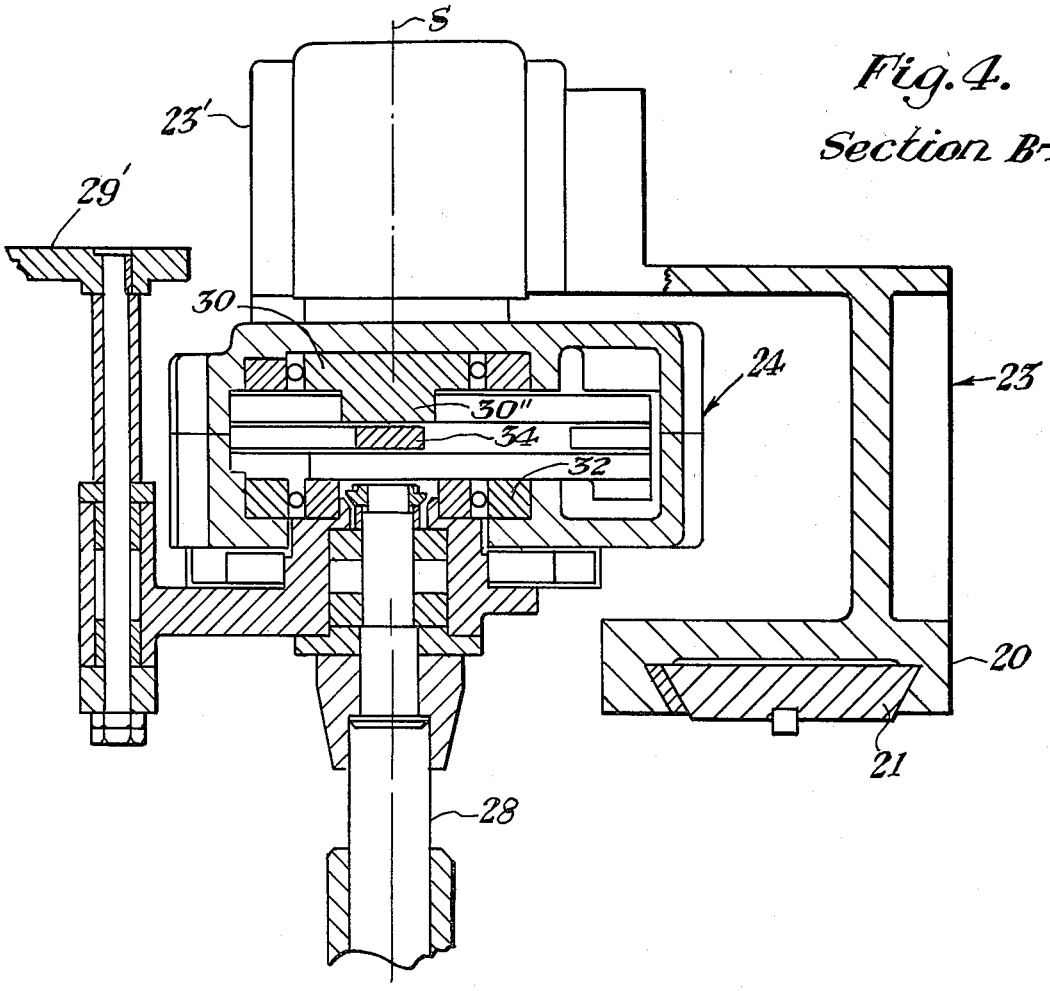
FIG. 4 is an end elevation view of section B—B in FIG. 2.
Figure 5:
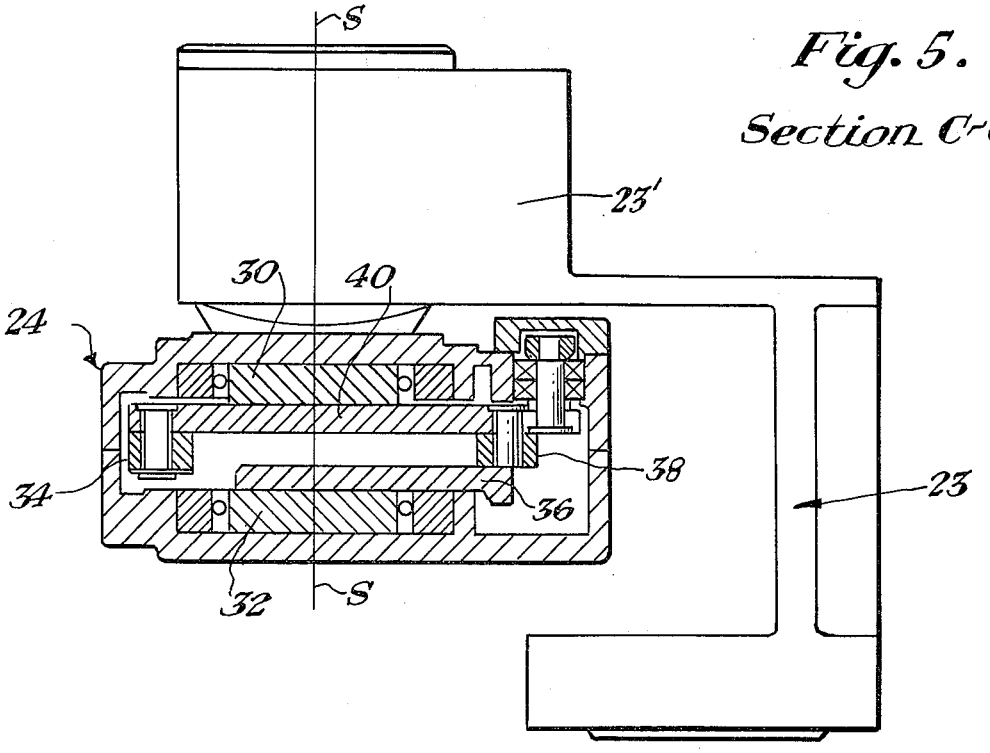
FIG. 5 is another end elevation view of section C—C in FIG. 2.
Figure 7:
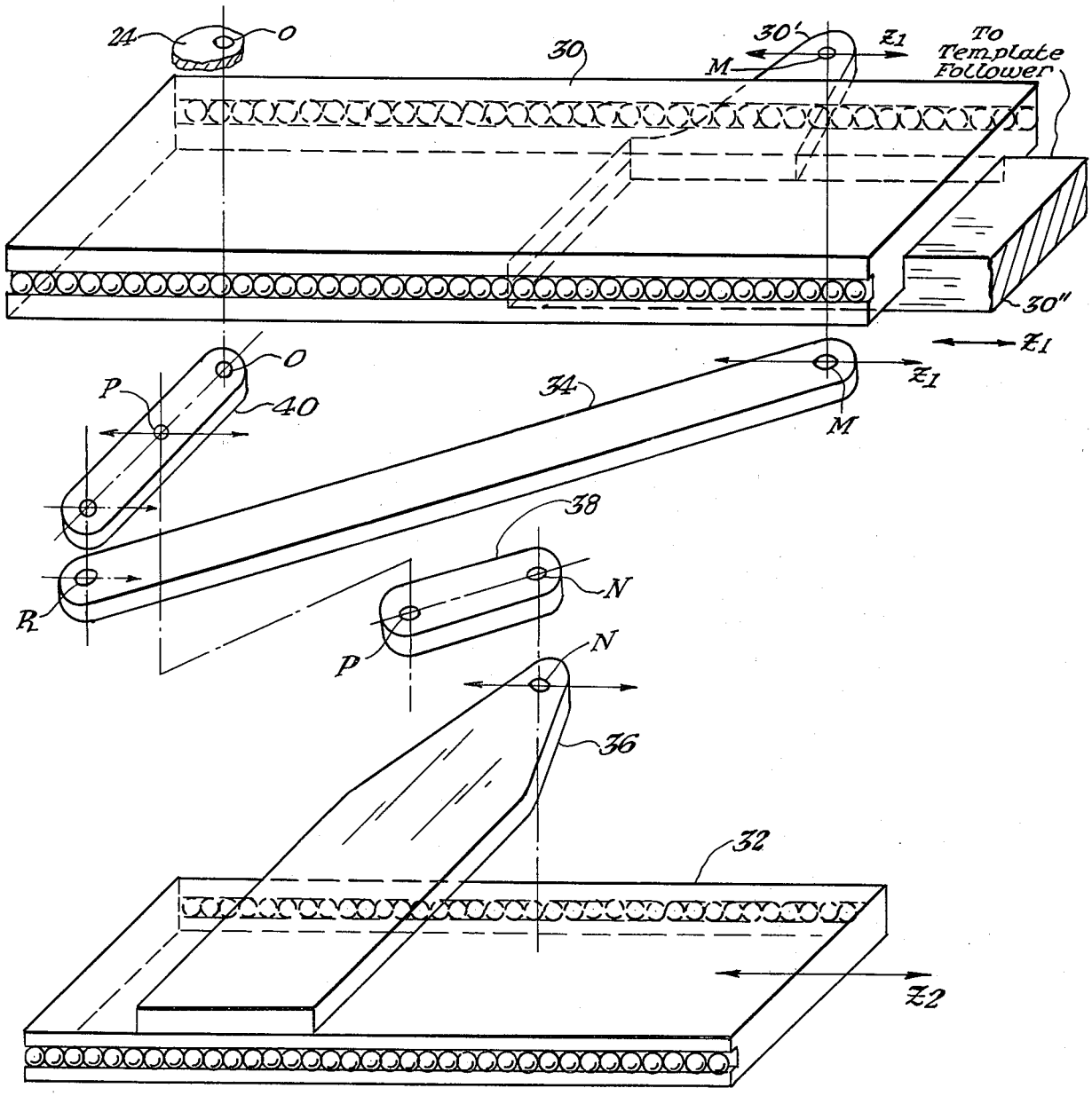
FIG. 7 is a perspective view of the new ratio linkage and slides.

Referring first to the drawings in my previous U.S. Pat. No. 3,022,780, particularly to FIGS. 1 to 4, inclusive and to FIGS. 1 and 2 for the instant invention, the grinding wheel dressing apparatus 10 includes a housing slide 20 slidably mounted on slide wheel 21 secured to any convenient part of the grinding wheel apparatus as by bolting. Adjustment of the housing slide 20 transversely in relation to the wheel being dressed 18 is accomplished by means of the micrometer adjustment screw 22.

The slide 20 is provided with a support or yoke 23 which pivotally supports the housing 24 at 23'. Mounted within the housing are the follower and tool slides, which pivotally support the template follower 27 and the dressing tool 28 respectively.

Attached to the slide 20 is the template support plate 25 on which is supported the template 26. The follower and the tool are connected together by the linkage mechanism 29 so that the follower 27 can be rotated about its vertical axis F an angle G, an optimal angle to the template at any point, and to translate that angle G to identical angle G' between tool and grinding wheel surface.

The housing 24 containing the tool and follower slides comprises a lower portion in which the tool slide is mounted and an upper or cover portion in which the follower slide is mounted. The upper portion of the housing is provided with an upwardly directed spindle received within a bearing assembly supported on the housing support yoke. This arrangement rotatably supports the housing from the yoke. A link mechanism is pivotally connected to the slides and housing and results in parallel differential movement of the slides when the follower 27 is moved across the contour of the template 26. This causes the tool 28 to follow a contour on a reduced scale on the surface of the wheel being dressed.

Figure 9:
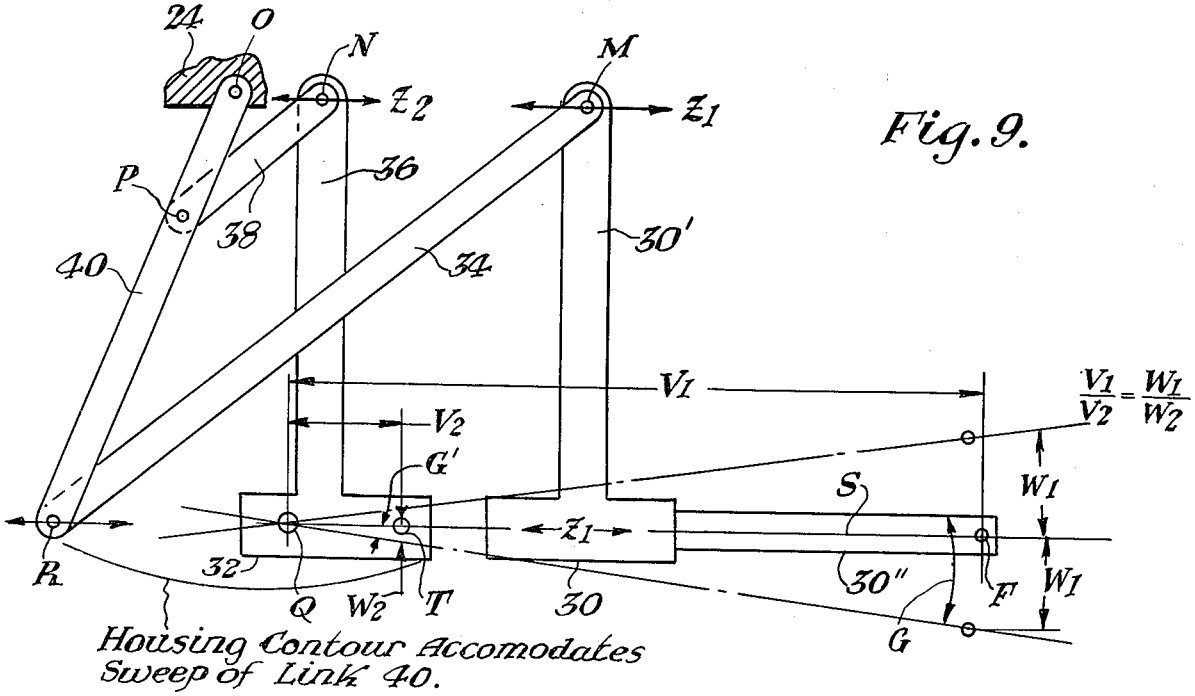
FIG. 9 is a schematic diagram of the new ratio linkage and slides incorporated into the apparatus shown in the other figures.

Referring again to my previous U.S. Pat. No. 3,022,780, the housing slide 20 can be adjusted along the slide guide 21 by means of the adjusting screw 22. Referring to FIGS. 9 and 11 the adjusting screw 22 is rotatably mounted on the housing 20 by the plate 90 and engages a nut 91 secured to slide guide 21. Rotation of the screw 22 by means of knurled knob 92 causes the housing slide 20 and all parts thereon to move toward and from the axis of rotation of the grinding wheel 18 being dressed.

Referring henceforth exclusively to the instant invention and drawings, FIGS. 2 through 9 show the follower slide 30 mounted in the upper portion of housing 24 and tool slide 32 slidably mounted in the lower portion of housing 24. Follower slide extension 30'' supports the template follower 27 for pivotal movement of the follower about axis F. Tool slide 32 pivotally supports tool 28 about pivotal axis T. The entire housing 24 is pivotally mounted in yoke 23 at pivotal axis Q.

Also included in the instant invention are links 34, 38 and 40, all pivotally interconnected to the two slides and to housing 24 through wear-resistant pins and bearings. Link 34 includes two pivotal connector points M and R near the ends. Connection point M on link 34 interconnects to connection point M on 30', an extension of follower slide 30. The opposite connection point R on link 34 interconnects to connection point R on link 40. The opposite end of link 40 at point O is pivotally attached to the upper part of housing 24 at 0. Intermediate link 38 includes two end connection points N and P. Connection point P on link 38 interconnects to connection point P on link 40 located between the two end connection points in link 40. The opposite connection point N on link 38 interconnects to point N on 36, an extension of tool slide 32.

Figure 8:
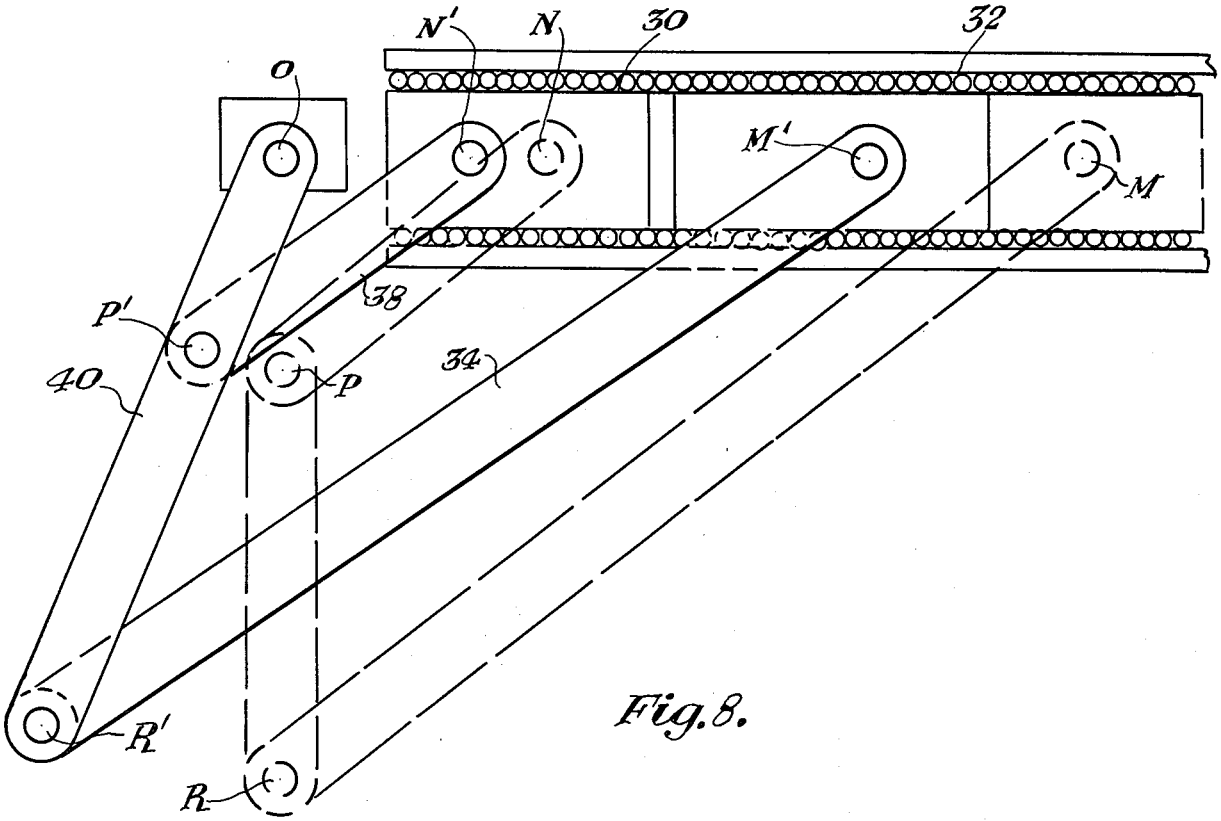
FIG. 8 is a schematic diagram of the new ratio linkage and slides incorporated into the apparatus shown in the other figures.

Referring now to FIGS. 8, 9 and 10, the theory of operation of this new and improved linkage system will now be explained. As slide 30 moves linearly to the left, repositioning point M to point M', link 34 rotates clockwise, pulling link 38 also to the left. Point N moves with slide 32 to point N'. The ratio between the movements of slide 32 and slide 30 is equal to $Y_1/Y_2$ the mechanism ratio. Assuming that the distance of linear movement of slide 30 is equal to $Z_1$, the movement of slide 32 is equal to $Z_1 \times Y_1/Y_2$ or $Z_2$. In FIG. 9, point F on follower slide extension 30'' is the pivotal axis of the follower while point T on tool slide 32 is the pivotal axis of the tool. Point Q is the pivotal axis for the entire housing 24 which carries the slides therein. Points F, T and Q are colinear along S. As S is pivoted at Q an angle G at F, T also pivots about Q an identical angle G'. The ratio of pivotal movement between F and T is $W_1/W_2$ which is also proportioned to $V_1/V_2$. The mechanism ratio, by similar triangles shown in FIG. 10 is $X_2/X_1=Y_2/Y_2=X_4/X_3=Y_4/Y_3=Z_1/Z_2$.

The instant invention has now been shown and described herein in what is considered to be the most practical and preferred embodiment. It is recognized, however, that departures may be made therefrom within the scope of the invention and that obvious modifications will occur to a person skilled in the art.

What I claim is:

1. In an apparatus for forming contours on a grinding wheel having a support, a housing pivotally mounted on said support, two slides mounted in said housing movable parallel to each other, a tool pivotally mounted on one of said slides, a follower pivotally mounted on the other of said slides, a pivot member mounted on each of said slides and said housing, a first link mechanism connected to said pivot member for pivotally connecting said slides and said housing to determine relative linear movement of said slides, a template mounted on said support, said follower being adapted to contact said template, the pivot axis of said housing, said tool and said follower lying in the same plane, a second link mechanism connecting said follower and said tool for controlling pivotal movement of said tool, the improvement in said first link mechanism comprising:

a first link pivotally connected at one end to said pivot member mounted on said follower carrying slide;

a second link pivotally connected to said pivot member mounted on said housing and the other end of said first link; and a third link pivotally connected to said pivot member mounted on said tool-carrying slide and the mid-portion of said second link.

* * * * *